United States Patent [19]

Cortellucci

[11] Patent Number: 4,618,090

[45] Date of Patent: Oct. 21, 1986

[54] ONE PIECE DOUBLE SHELL BOX WITH CLOSURE FASTENER

[75] Inventor: Giancarlo Cortellucci, Civitanova Marche, Italy

[73] Assignee: Studio Tecnico A.C. s.r.l., Italy

[21] Appl. No.: 603,354

[22] Filed: Apr. 24, 1984

[51] Int. Cl.[4] ..... B65D 6/00

[52] U.S. Cl. ..... 229/45 R; 206/45.34; 220/4 E; 220/326; 220/339

[58] Field of Search ..... 206/45.34, 541, 545; 229/44 R, 45 R; 220/4 E, 4 B, 324, 326, 337, 339

[56] References Cited

U.S. PATENT DOCUMENTS

| | | | |
|---|---|---|---|
| D. 218,922 | 10/1970 | Vore et al. | 220/339 |
| 2,613,804 | 10/1952 | Hughes | 220/324 |
| 3,390,809 | 7/1968 | Becucci | 220/326 |
| 3,511,433 | 5/1970 | Andrews et al. | 229/44 R |
| 3,698,548 | 10/1972 | Stenzel et al. | 229/45 R |
| 3,767,110 | 10/1973 | Congleton | 220/4 B |
| 3,776,375 | 12/1973 | Rohdin | 220/4 E |
| 3,800,998 | 4/1974 | Gask | 206/45.34 |
| 3,813,025 | 5/1974 | Solomon | 229/44 R |
| 3,977,595 | 8/1976 | Hillgenberg | 229/45 R |
| 4,243,140 | 1/1981 | Thrun | 220/339 |

FOREIGN PATENT DOCUMENTS

| | | | |
|---|---|---|---|
| 2557540 | 6/1977 | Fed. Rep. of Germany | 220/339 |
| 2423411 | 12/1979 | France | 220/339 |
| 1305739 | 2/1973 | United Kingdom | 229/44 R |

*Primary Examiner*—William Price
*Assistant Examiner*—Gary E. Elkins
*Attorney, Agent, or Firm*—Birch, Stewart, Kolasch & Birch

[57] ABSTRACT

Disclosed herein is a one piece box that tips back to open and is formed out of one single faced cardboard blank of a conventional aspect and parallelepiped shape comprising, in the closed position, two shells, the open parts of which face each other on opposite sides and are joined on the median longitudinal axis of a base wall, common to both, which, through simple deformation of the material along the said axis, constitutes the main rotation pivot for opening the box.

2 Claims, 8 Drawing Figures

FIG1
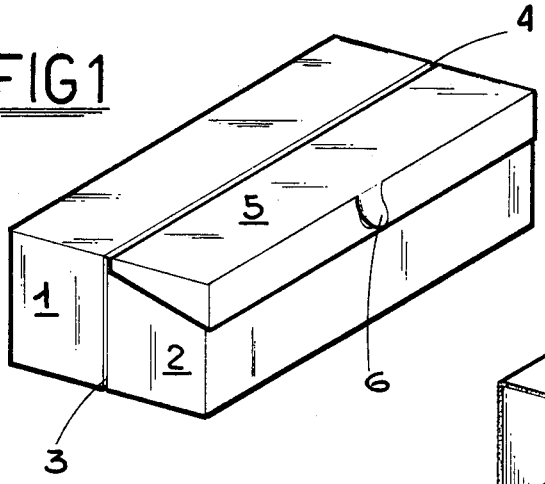
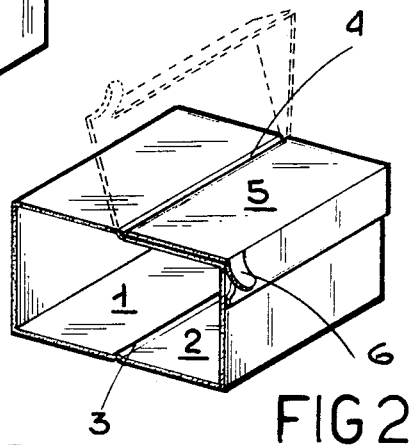
FIG2
FIG3
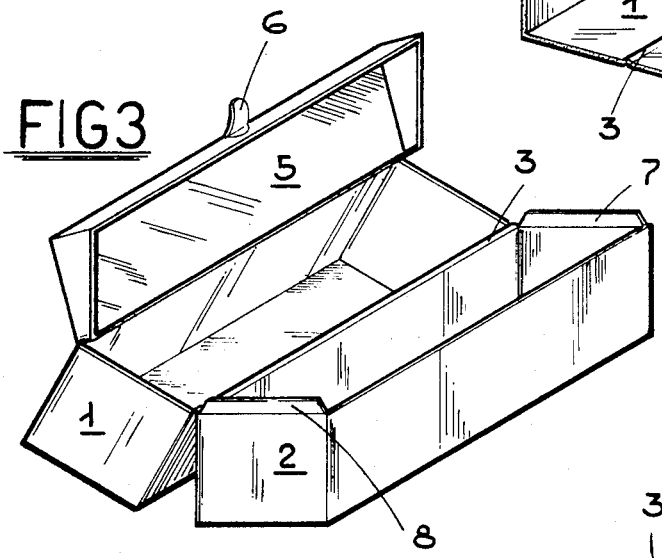
FIG4
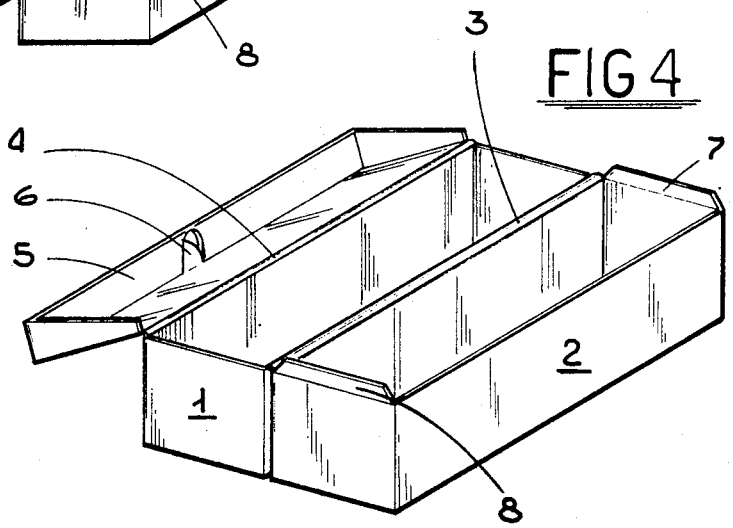

ONE PIECE DOUBLE SHELL BOX WITH CLOSURE FASTENER

BACKGROUND OF THE INVENTION

The invention relates to a box for packing industrial products for which there is a heavy consumption, particularly footwear.

DESCRIPTION OF THE PRIOR ART

Boxes of the type in question, normally made of cardboard in various sizes and composed of a bottom part and a lid of rigid parallelepiped shape, are necessary for the products to be transported, stored and put on display to the public.

In the final form thereof, the boxes are faced externally with paper of various designs and colors so that the products they contain may be identified.

The normal practice is for the consumer to take delivery of the boxes stably and rigidly pre-erected, ready to be filled.

The lid, made separately from the bottom part of the box is liable to be supplied apart, thereby causing in the packing stage and at the time the product is delivered to the sales center, confusion with other lids to the disadvantage of the image of the product to be sold.

The said image is made even worse at the time the boxes are being unpacked because of the presence inside of a sheet, generally of paper, folded around the footwear and there to protect and isolate each boot or shoe so that they do not undergo rubbing.

SUMMARY OF THE INVENTION

The object of the invention is to overcome the problems encountered with known boxes by making available a one piece box of a new type for footwear that tips back to open, is inexpensive and wherein a lid separate from the packing body is not envisaged and with which the image of the product to be sold, which definitely needs to be seen in the most elegant and fastest way is indeed presented more rapidly, more elegantly and in a far more instantaneous fashion, the said box being of a conventional aspect, in a two shell parallelepiped form so that it be possible not to have to handle continuously the box or the product contained therein, at the time this is being displayed or examined for sales purposes, and studied in particular to cater for medium sizes, the novelty thereof being that it is constituted by one single cardboard blank or by one single colored or transparent plastic material molding which acts contemporaneously both as an internal protection and as the external packing, without any part being detached; the structure of the said box being compact, able to withstand being opened an unlimited number of times for the product contained in and protected by the said shells to be removed and examined, and light, with a central pivot on the base and the closure at the top, the opening and closing operations being simple and effected without any difficulty at both the boxing and the sales centers by moving one shell away from the other and by bringing the two shells together again, respectively; it being possible to use all known types of box closing systems, such as those that snap close, latches of a common type, and those made in the conformation of the box, while the main pivot of rotation can be fashioned simply by deforming the base wall, in the median longitudinal axis thereof, or else fitted mechanically or with some other similar method, utilizing a known type of pivot; in the case of a cardboard box, the possibility also exists of fitting a double frame, made of plastic or other similar material, stapled or bonded or fixed to the said shells in some other known way, this comprising the latching means and the main pivot of rotation of the two shells; both when joined by a pivot made in the conformation thereof or by one purposely inserted, the shells can, when no internal facing is envisaged, be made of plastic or of a similar transparent material so that the product contained therein be visible without having to display it outside the packing box, that is to say, without exposing the product to dust and possibly to being handled.

Another object of the invention is to make available a box of a robust conformation and sound structure with which any danger of damage to the contents can be averted.

Yet another object of the invention is to facilitate the presentation of the products and to give them elegance, protection and simplicity.

A further object still of the invention is to enable the contents of the box, the conformation of which be rational so as to render easier the use thereof, to be readily identifiable and clearly visible.

The said objects and others too that will become more apparent in the text that follows are indeed attained by the box forming the subject of the invention, comprising: two shells made of lined cardboard or colored or transparent plastic material or similar, which in the normal position, namely with the box closed, each have the open part facing the other on opposite sides; a main pivot of rotation that joins one shell to the other, fashioned simply by deforming the base wall common to both, or using a known type of pivot that is fitted thereto, or one that is part of a composite premolded double frame system in which the element that constitutes the lid for closing the shells is included; and a secondary pivot made in the upper median longitudinal axis of the box.

BRIEF DESCRIPTION OF THE DRAWINGS

The characteristics of the box according to the invention will now be outlined more fully in the description that follows of two preferred; but not sole, embodiments, illustrated purely as unlimited examples on the accompanying drawings, in which:

FIG. 1 shows, in a perspective view, a one piece box made out of one single externally faced cardboard blank;

FIG. 2 shows, in a perspective view, a cross section of the box along the center line thereof;

FIG. 3 shows, in a perspective view, the box at the time of being opened;

FIG. 4 shows, in a perspective view, the box in the fully open position for packing or displaying the product at the sales center;

DESCRIPTION OF THE PREFERRED EMBODIMENTS

Figure 5:
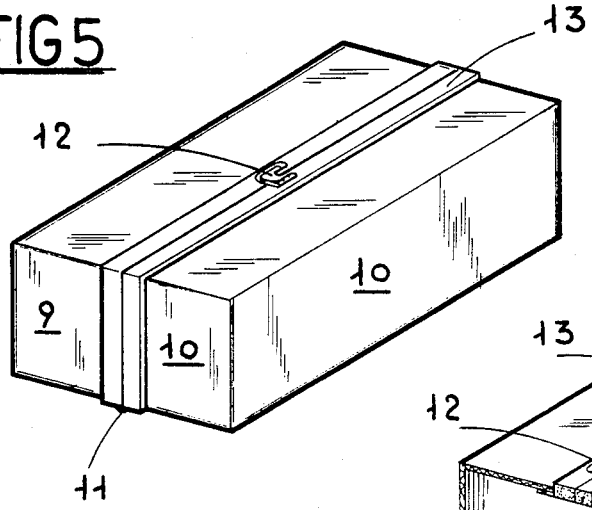
FIG. 5 shows, in a perspective view, an alternative embodiment for the box in question.

The one piece box shown in FIG. 1, made out of one single externally faced cardboard blank, comprises: an element (5) that constitutes the lid; a latching tongue (6) which facilitates opening the box; two hollow shells (1) and (2) of parallelepiped shape; a secondary pivot (4) made in the upper median longitudinal axis, between the shell (1) and the element (5), this being derived from an extended part of the upper wall of the said shell (1); and a main pivot of rotation (3) made in and shaped out of the base wall common to both the shells (1) and (2), in the median longitudinal axis thereof. The said shells (1) and (2) are seen, in FIG. 1, one facing the other on opposite sides, and in this condition the pressure exerted by the border of the element (5) prevents the shell (2) from rotating around the main pivot (3).

A partial rotation of the element (5) around the secondary pivot (4) is shown in dashes in FIG. 2 wherein the parts inside the box depicted in FIG. 1 can be seen.

At the time the box is being opened (FIG. 3), the shells (1) and (2) rotate around the main pivot (3) because of the pressure generated by the rotation, through the lifting thereof by means of the latching tongue (6), of the element (5) with respect to the secondary pivot (4) and to the main pivot of rotation (3). Two flaps, (7) and (8), respectively, that are part of the vertical walls of the shell (2), useful though not indispensable for the guided closing of the two shells, protect the product contained therein against dust and isolate it.

When the box is in the fully open position for packing the product therein or for the display thereof at the sales center, the shells (1) and (2) are both open upwards and thus the product can be examined and withdrawn. The element (5), turned backwards, frees, because of being of a reduced size, the inspection and withdrawal area.

For the alternative embodiment shown in FIG. 5, the box is constructed with the aid of a double frame (13) in which are comprised a main pivot (11) for rotating the shells, in this case shown at (9) and (10), and a top latching system (12) of any type, needed to keep the said shells (9) and (10) facing each other on opposite sides, when in the closed position.

The two shells (9) and (10), made of lined cardboard or of colored or transparent plastic material or similar, are connected to the said premolded plastic or other similar material double frame (13).

When using stress tangential to the main pivot (11), the top latch (12) either suitably shaped into the two frames (13) or fitted thereto, is freed, the shells (9) and (10) rotate (at the time they are being opened) around the said main pivot (11) that is an integral part of the said double frame (13) and is fashioned therein simply by reducing the gage of the material that unites the two frames underneath.

Figure 6:
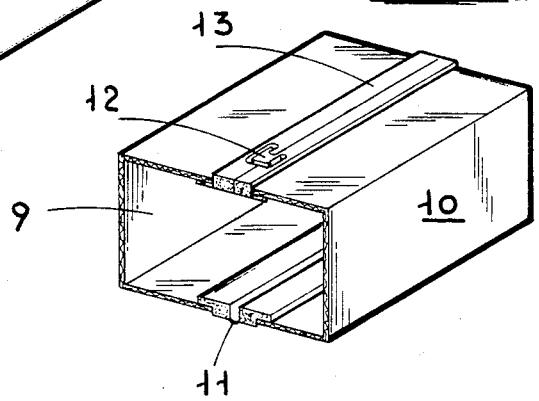
FIG. 6 shows, in a perspective view, a cross section of the box depicted in FIG. 5.

In FIG. 6 an inside view of the box depicted in FIG. 5 renders particularly visible the main pivot (11) which, as stated above, is an integral part of the double frame (13).

Figure 7:
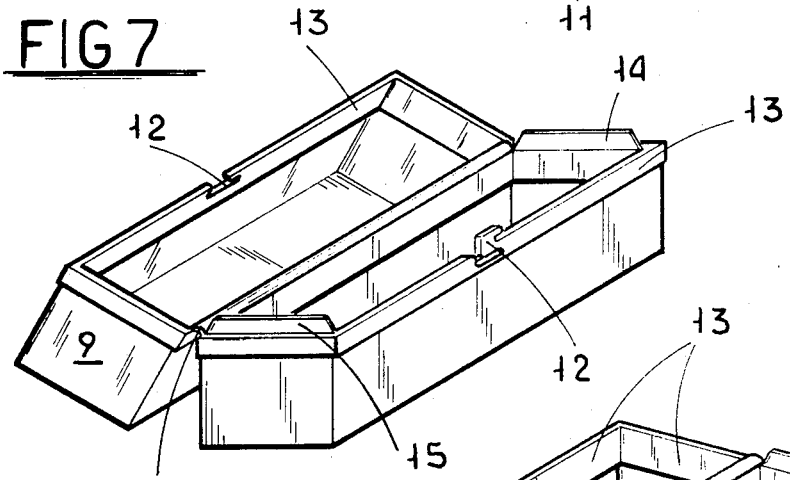
FIG. 7 shows, in a perspective view, the box at the time of being opened.

At the time the box is being opened (FIG. 7), the shells (9) and (10) rotate around the axis of the pivot (11) because of the pressure generated thereon by the freeing of the top latch (12) which can be provided with a tongue. Two flaps (15), one at each side of the half of the double frame (13) that is connected to the shell (10), made in the vertical sides of the latter, useful though not indispensable for the guided closing of the two shells (9) and (10), protect the product contained therein against dust and, when folded back, isolate it.

Figure 8:
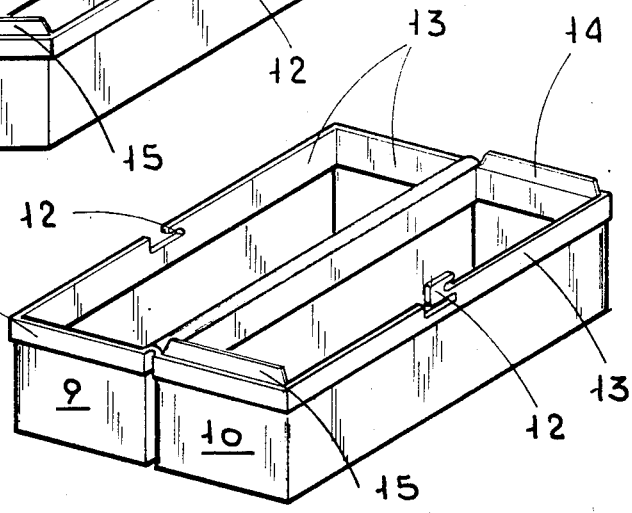
FIG. 8 shows, in a perepective view, the box in the fully open position for packing or displaying the product at the sales center.

Fully open (FIG. 8) for packing the product therein or for the display thereof at the sales center, the shells (9) and (10) of the box are both open upwards and thus the product can be examined and withdrawn in an unobstructed fashion.

It can readily be appreciated from the two alternatives described above and illustrated in the figures, that with a simple movement the box forming the subject of the invention can be opened and reclosed.

In the practical embodiment thereof, the box in question can differ in form from what has been described in the foregoing text and illustrated in the figures and, in particular, numerous modifications of a practical nature may be introduced without in any way deviating from the framework of protection afforded to the invention as claimed hereunder.

What is claimed is:

1. A one piece box which may be tipped back to open for packing industrial products, particularly footware, comprising, first and second shells, each said shell having an open part with said two open parts facing each other when said shells are positioned to provide a closed box, a base wall common to both said shells and having a median longitudinal axis, means for joining said shells and for providing for rotation of said shells located along said median longitudinal axis of said base wall, each said shell including an opposite wall parallel to said base wall, and having an edge parallel to said median longitudinal axis of said base wall, a closure member pivotally joined to said first shell along said opposite wall edge, said closure member having a wall surface and three side walls perpendicular to said wall surface and directed toward said second shell, and said wall surface being sized to fit over said second shell opposite wall so that when said open parts are positioned to provide a closed box, said closure member provides means positioned to enclose said second shell opposite wall.

2. The one piece box according to claim 1, wherein said shells and said joining and rotation means are constituted by a same flexible material, said shells being joined by said flexible material on said median longitudinal axis of said base wall common to both said shells so that said joining or rotation means for opening said box operates through simple deformation of said material along said axis.

* * * * *